United States Patent [19]

Koga

[11] 3,935,400

[45] Jan. 27, 1976

[54] OVAL DOME TYPE SPEAKER

[75] Inventor: Sigeyuki Koga, Hachioji, Japan

[73] Assignee: Trio Kabushiki Kaisha, Tokyo, Japan

[22] Filed: Feb. 21, 1975

[21] Appl. No.: 551,387

[30] Foreign Application Priority Data

Feb. 28, 1974 Japan ..... 49-23828

[52] U.S. Cl. ..... 179/115.5 R; 179/181 R; 179/180; 181/173

[51] Int. Cl.[2] ..... H04R 9/02; H04R 9/06

[58] Field of Search ..... 179/115.5 R, 181 R; 181/157, 171, 172, 173

[56] References Cited

UNITED STATES PATENTS 2,020,705 11/1935 W. C. Stenger ..... 181/172

*Primary Examiner*—Kathleen H. Claffy
*Assistant Examiner*—George G. Stellar
*Attorney, Agent, or Firm*—Gerald J. Ferguson, Jr.; Joseph J. Baker

[57] ABSTRACT

A speaker assembly comprising a dome shaped diaphragm, the cross section along the plane containing the base of the diaphragm having an oval contour; a voice coil connected to the diaphragm; magnetic means operatively associated with the voice coil; and support means for supporting the diaphragm, voice coil and magnetic means.

9 Claims, 7 Drawing Figures

FIG. 1
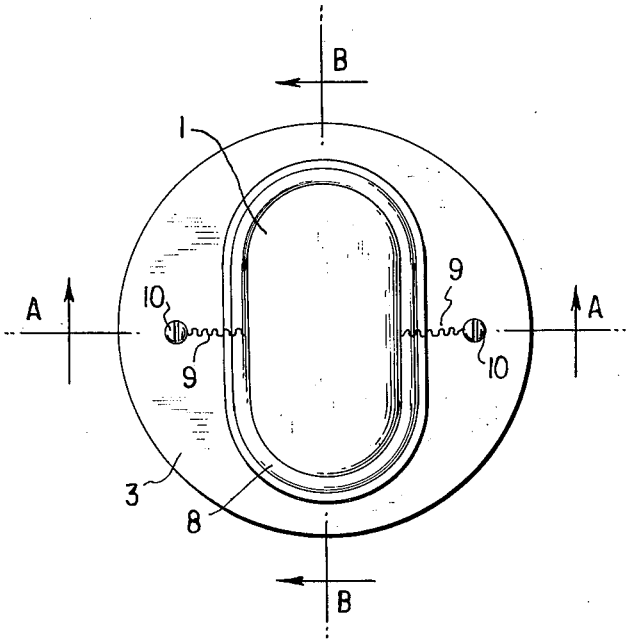
FIG 3
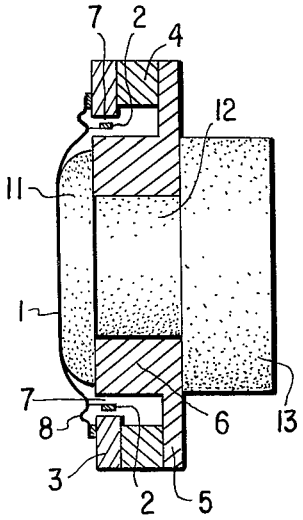
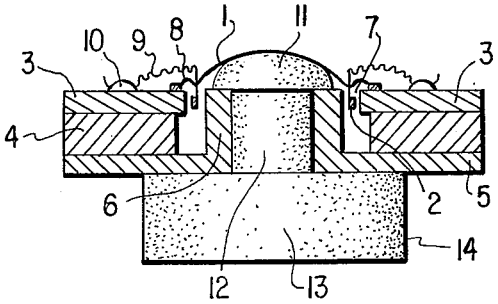
FIG. 2

OVAL DOME TYPE SPEAKER

BACKGROUND OF THE INVENTION

1. Field of the Invention

This invention relates to speakers and, in particular, to speakers having a dome-shaped diaphragm.

2. Discussion of the Prior Art

In most conventional dome type speakers, the dome has a diameter not greater than 60mm. Such speakers usually include a circular-shaped voice coil mounted on an outer peripheral portion of a circular dome type diaphragm. As a consequence, conventional dome type speakers suffer from various drawbacks as noted below:

a. A satisfactory oscillation area for improving directivity cannot be obtained. In addition, when the Q of the low-pass resonance region of the oscillation system is designed to provide a uniform regeneration band to cover the low-pass region, efficiency is decreased, and if it is designed to increase efficiency, the Q decreases in value, resulting in a narrow regeneration band.

b. Generally stated, in dome type speakers, the voice coil functions to drive the outer peripheral portion of the dome-shaped diaphragm, and for this reason, transfer of high-pass components in the diaphragm, in a split band, occurs in a closed path at top of the diaphragm to generate a standing wave in the diaphragm to decrease energy loss therein. This causes a deviation in phase between the top of the diaphragm and the outer peripheral portion by the voice coil to produce "peak-dip" or dip in the frequency characteristic. In order to improve this, an equalizer may be used; however, the use thereof provides no essential improvement in the poor movement of the diaphragm.

c. If loss in the diaphragm is increased, energy is not sufficiently transmitted to the top of the diaphragm, and although the peak-dip of the frequency characteristic may be improved, the efficiency in the high-pass region is decreased. Thus, there is a merit in the operational principle of a piston motion, but there is a significant disadvantage in terms of the physical characteristic in a split oscillation band.

d. If a diaphragm of larger diameter is used to increase the efficiency, the upper limit of the high-pass region of the regeneration bandwidth is lowered, and if a further attempt is made, in order to improve the aforementioned drawback, to provide a sharp angle at the junction formed between the coil bobbin and the diaphragm, the equivalent mass of the diaphragm, particularly in the high-pass region, is increased, thereby resulting in a shortage of energy in this region.

SUMMARY OF THE INVENTION

The present invention overcomes the various disadvantages noted above with respect to prior art dome type speakers, and has its object to improve various characteristics and the tone quality of such speakers.

It is a further object of this invention to provide a dome type speaker having an oval configuration.

It is a further object of this invention to provide a speaker of the above type having an oval voice coil associated therewith.

Other objects and advantages of this invention will be apparent from a reading of the following specification and claims taken with the drawing.

BRIEF DESCRIPTION OF THE DRAWING

FIG. 1 is a plan view of an illustrative embodiment of an oval dome type speaker in accordance with the invention.

FIG. 2 is a schematic sectional view taken on line A—A of FIG. 1.

FIG. 3 is a schematic sectional view taken on line B—B of FIG. 1.

DETAILED DESCRIPTION OF THE PREFERRED EMBODIMENT

Figure 4:
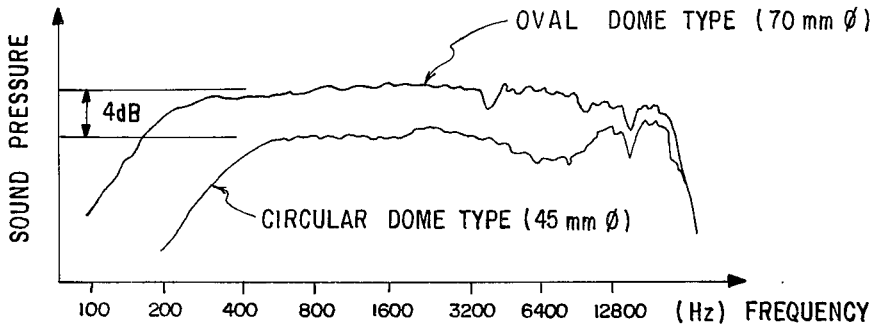
FIG. 4 illustrates comparative frequency characteristic curves of a 45 mm$\phi$ circular dome diaphragm and an oval dome diaphragm having the length of long axis of 90mm, the length of short axis of 45 mm and the same area as that of a 70 mm$\phi$ circular dome diaphragm.

Referring now to FIGS. 1–3, a dome-shaped diaphragm 1 is shown. As can be seen in FIG. 1, a cross section along the plane containing the base of dome-shaped diaphragm 1 would have an oval-shaped contour. The term "oval" as used in the specification and claims applies not only to oblong contours with rounded ends as shown in FIG. 1 but also elliptical contours (from which ellipsoids may be generated) and oblongs, the contours of which are entirely curvilinear. In no instance is the term oval applicable to a circular contour.

A voice coil 2 is connected to the outer peripheral portion of the diaphragm and is also oval and surrounds the diaphragm. The speaker also comprises a top plate 3, a permanent magnet 4, a back plate 5, a center pole 6, and a magnetic pole gap 7, which gap also has an oval configuration. Thus, the speaker of the present invention is operatively different from conventional elliptical cone type speakers in which a circular voice coil is connected to an elliptical cone. The speaker also includes an edge portion 8 functioning as a suspension, lead wires 9, terminals 10, means for absorbing back pressure 11 such as glass wool, a sound absorbing material 12 (such as glass wool) filled in a bore formed in center pole 6, a sound absorbing material 13 mounted at the rear of center pole 6, and a back cavity 14.

It should be noted that with diaphragm 1, directivity in the horizontal direction shown in FIG. 1 is important when using a systematized form, and therefore the diaphragm has its short axis in the horizontal direction to provide the directivity in this direction. Generally speaking, the short axis corresponds to a first axis (not shown) extending between one side of the base of the diaphragm and the side opposite thereto and a second axis (the long axis) orthogonal to the first axis extends from another side of the base to the side opposite thereto. Satisfactory results may be obtained when the ratio of the length of the long axis to that of the short axis extends from about 1.2 to about 3.

In accordance with the present invention, if the ratio of the length of the short axis to the length of the long axis is, for example, 1 : 2; the area of diaphragm 1 will be approximately two and a half times that of a circular-shaped dome diaphragm having the same diameter as the length of the short axis. As a result, displacement of the diaphragm is increased by approximately two and a half times to increase the efficiency in the low-pass region and the regeneration band is decreased by approximately one octave. As can be seen in FIG. 4, when the value of Q in minimum resonance frequency of an oval dome diaphragm having the same area as that of the 70 mm$\phi$ circular dome diaphragm was set to the same as that of a 45 mm$\phi$ circular dome diaphragm, the efficiency was increased by approximately 4 db where FIG. 4 illustrates characteristic curves of sound pressure vs. frequency for the two diaphragms. In particular, FIG. 4 illustrates results of tests conducted on a diaphragm of the circular dome type having a diameter of 45 mm and on a diaphragm of the oval dome type having the length of long axis of 90 mm, the length of short axis of 45 mm and the same area as that of the 70 mm$\phi$ circular dome type diaphragm.

Figure 5:
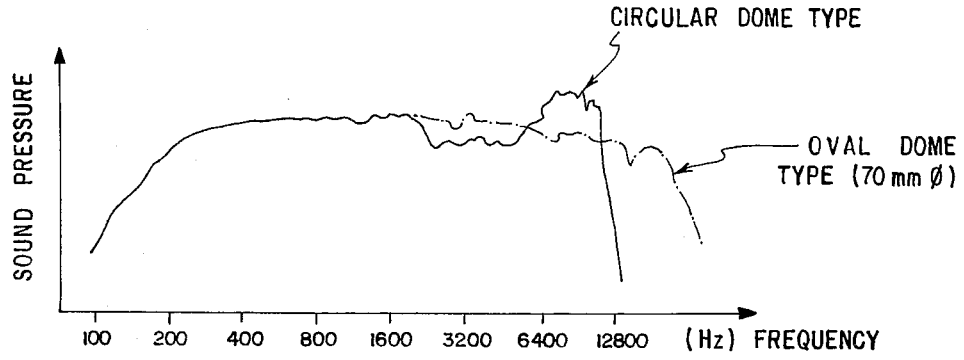
FIG. 5 illustrates comparative frequency characteristic curves for a 70 mm$\phi$ circular dome diaphragm and an oval dome diaphragm having same area as that of the former.

Characteristic curves of sound pressure vs. frequency are also shown in FIG. 5 and they give a comparison between a 70mm$\phi$ circular dome type diaphragm and an oval dome type diaphragm of the same area. As is apparent from these characteristic curves, the oval dome type diaphragm increases the upper limit of the high-pass region to thereby provide a speaker which is wide in band width.

Figure 6:
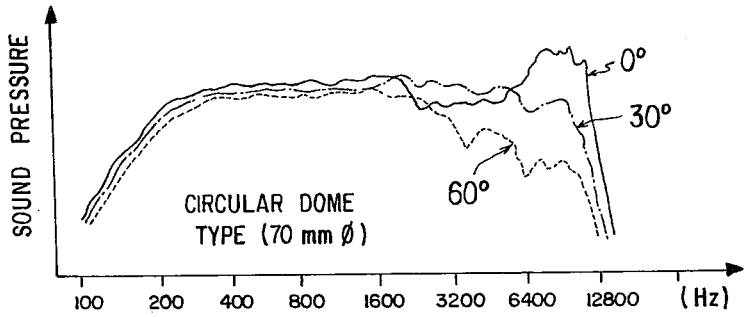
FIGS. 6 and 7 illustrate the directivities of the diaphragm of FIG. 5.
Figure 7:
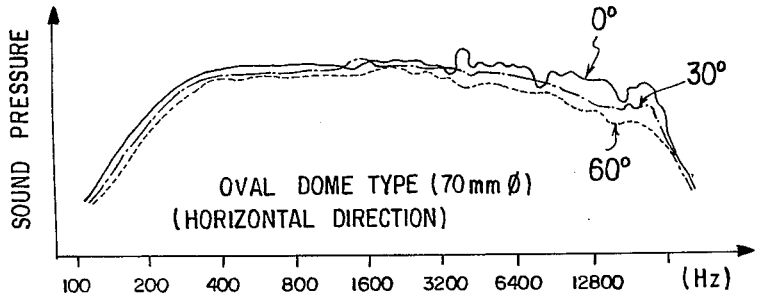

Further, directivities of a circular dome type speaker and an oval dome type speaker, both of which have the same diaphragm area, are illustrated in FIGS. 6 and 7, respectively. In the oval dome type speaker shown in FIG. 7, the short axis is in the horizontal direction. According to these curves, it can be seen that the directivity of the oval dome type speaker in the horizontal direction is better than that of the other for both 30° and 60°p. When using a circular speaker having a low energy loss diaphragm, a wide dip appears in the characteristic curve in the medium and high-pass regions with a peak in the high-pass limit. With an oval diaphragm, however, less resonance is produced at a specific frequency so that the resonance energy in the split oscillation band may be dispersed whereby no wide dip occurs and hence there is a narrow resonance band.

Further, since the diaphragm has an oval shape, the edge portion 8 thereof, of course, has a shape corresponding thereto, and the results of an actual operating test demonstrate that the edge portion operates excellently as a suspension, producing less resonance in the edge with hardly any rolling or the like occurring.

Therefore, the dome type speaker according to the present invention has various advantages; the speaker is high in efficiency; wide in regeneration band; low energy loss diaphragms may be used without the provision of an equalizer; dips in the frequency characteristic may be considerably reduced; and the suspension of the oscillation system may be stabilized.

What is claimed is:

1. A speaker assembly comrising a dome shaped diaphragm, the cross section along the plane containing the base of said diaphragm having an oval contour;

a voice coil connected to said diaphragm;

magnetic means operatively associated with said voice coil; and support means for supporting said diaphragm, voice coil and magnetic means.

2. A speaker assembly as in claim 1 where a first axis extends from one side of the base of said diaphragm to the side opposite thereto and a second axis orthogonal to said first axis extends from another side of said base of the diaphragm to the side opposite said another side, said second axis being longer than said first axis; and where said supporting means so supports said diaphragm that said first axis is horizontally disposed to thereby improve the horizontal directivity of said assembly.

3. A speaker assembly as in claim 2 where the ratio of the length of said second axis to that of said first axis extends from about 1.2 to about 3.

4. A speaker assembly as in claim 1 where said contour is elliptical.

5. A speaker assembly as in claim 1 where said contour is oblong and entirely curvilinear.

6. A speaker assembly as in claim 1 where said voice coil surrounds and is connected to the periphery of said diaphragm approximately at said base thereof, said coil also having an oval configuration corresponding to that of said base of the diaphragm.

7. A speaker assembly as in claim 6 where said magnetic means includes an air gap having an oval configuration, said coil being disposed in said gap.

8. A speaker assembly as in claim 1 where said diaphragm includes an edge portion connected between said base of the diaphragm and said support means, said edge portion having an oval configuration corresponding to that of the base of the diaphragm and suspending said diaphragm with respect to said support means.

9. A speaker assembly as in claim 1 where said magnetic means is a permanent magnet.

* * * * *